US009376802B2

(12) United States Patent
Tao et al.

(10) Patent No.: US 9,376,802 B2
(45) Date of Patent: Jun. 28, 2016

(54) UNITARY BATHROOM

(71) Applicant: GuangZhou Honlley Composite Material Co., Ltd, Guangzhou (CN)

(72) Inventors: Skeep Tao, Guangzhou (CN); Mingwei Zhou, Guangzhou (CN); Guocheng Li, Guangzhou (CN); Xiaoliang Liu, Guangzhou (CN); Songchao Xiao, Guangzhou (CN)

(73) Assignee: GuangZhou Honlley Composite Material Co., Ltd, Guangzhou (CN)

( * ) Notice: Subject to any disclaimer, the term of this patent is extended or adjusted under 35 U.S.C. 154(b) by 0 days.

(21) Appl. No.: 14/420,725

(22) PCT Filed: Mar. 31, 2014

(86) PCT No.: PCT/CN2014/074419

§ 371 (c)(1),
(2) Date: May 6, 2015

(87) PCT Pub. No.: WO2015/058492

PCT Pub. Date: Apr. 30, 2015

(65) Prior Publication Data

US 2015/0240476 A1 Aug. 27, 2015

(30) Foreign Application Priority Data

Oct. 22, 2013 (CN) ..... 2013 1 0496959

(51) Int. Cl.

| | |
|---|---|
| ***E04B 1/348*** | (2006.01) |
| ***E04H 1/12*** | (2006.01) |
| *E04B 1/12* | (2006.01) |

(52) U.S. Cl.

CPC ..... *E04B 1/34869* (2013.01); *E04B 1/34815* (2013.01); *E04H 1/1266* (2013.01)

(58) Field of Classification Search

CPC ..... E04B 1/34815; E04B 1/34869; E04H 1/1266

USPC ..... 52/64, 70, 79.1, 79.5

See application file for complete search history.

(56) References Cited

U.S. PATENT DOCUMENTS

| | | | | | |
|---|---|---|---|---|---|
| 1,672,435 | A | * | 6/1928 | Sterner et al. | 52/204.55 |
| 3,388,514 | A | * | 6/1968 | Archinal et al. | 52/97 |
| 3,561,518 | A | * | 2/1971 | Johnson | 160/87 |
| 3,755,974 | A | * | 9/1973 | Berman | 52/73 |
| 4,622,911 | A | * | 11/1986 | Salminen | A47K 4/00 114/71 |

(Continued)

*Primary Examiner* — Charles A Fox
*Assistant Examiner* — Joseph J Sadlon
(74) *Attorney, Agent, or Firm* — IPro, PLLC; Na Xu; Qian Gu

(57) ABSTRACT

The present invention is directed to a unitary bathroom which includes an upper back panel, a lower back panel, a base, and side panels all of which are formed by aluminum honeycomb composite boards or paper honeycomb composite boards. The invention also relate to connection among above the upper back panel, lower back panel, base, side panels and ceiling. The unitary bathroom constructed according to the invention is reliable, and structurally stable. The bathroom will not be loosened after long term use. In addition, the unitary bathroom made of aluminum honeycomb composite board is lightweight, strong, and has good stiffness. The coating material may be freely selected from ceramic, artificial stone, natural stone, aluminum alloy, stainless steel, zinc coated steel plate, fire proof plate, SMC and plastic. Moreover, it has strong shock proof ability and high fire proof ability. No deformation and aging will occur after long term use.

1 Claim, 7 Drawing Sheets

(56) References Cited

U.S. PATENT DOCUMENTS 4,677,797 A * 7/1987 Roth ..... 52/94
4,787,181 A * 11/1988 Witten ..... E04H 9/10 220/4.21
5,487,241 A * 1/1996 Gorrell ..... E04B 1/043 52/253
5,903,937 A * 5/1999 Clarke ..... 4/663
6,360,545 B1 * 3/2002 Goldstone et al. ..... 62/45.1
6,481,172 B1 * 11/2002 Porter ..... 52/506.01
7,117,644 B2 * 10/2006 Dehart ..... 52/36.1
7,677,006 B2 * 3/2010 Rozenberg ..... A01G 9/16 52/582.2
8,307,582 B2 * 11/2012 Cook ..... A47K 3/40 52/35
8,769,886 B2 * 7/2014 Ohnishi et al. ..... 52/79.12
9,049,969 B2 * 6/2015 Cook ..... A47K 3/40
2008/0263968 A1 * 10/2008 Day ..... 52/79.1

* cited by examiner

UNITARY BATHROOM

CROSS REFERENCE TO RELATED APPLICATIONS

The present application is a national phase entry under 35 USC §371 of International Application No. PCT/CN2014/074419, filed on Mar. 31, 2014, which claims the benefit of and priority to Chinese Patent Application No. 201310496959.4, filed on Oct. 20, 2013, the entire disclosures of which are incorporated herein by reference.

FIELD OF THE INVENTION

The present invention relates to technical field of unitary bathroom and more particularly, relates to a unitary bathroom.

BACKGROUND OF THE INVENTION

Unitary bathrooms have been used in the marketplace for many years. A unitary bathroom is generally constructed of a base, a plurality of sidewalls and a ceiling. Prior art unitary bathroom utilizes light and thin sheet material with insufficient strength and hardness. In addition, coating material is tedious, decoration style is limited, and there is poor texture. Moreover, it will be easily deformed and its color will come out after long time use. Additionally, the unitary bathroom suffers from unsafe assembly and is susceptible to peeling off caused by aging and accordingly, the lifespan of the unitary bathroom is also shortened.

SUMMARY OF THE INVENTION

The following are technical problems to be solved by the present invention: to improve strength of the unitary bathroom, to increase types of the coating material, to enrich decoration styles, to enhance texture, to increase convenience during installation and transportation, and to extend lifespan of the bathroom. There is proposed a unitary bathroom which is formed by connecting several honeycomb composite boards together, thereby improving strength, stiffness, and decoration ability of the unitary bathroom while reducing weight. Further, convenience in installation and transportation is also enhanced. The lifespan of the bathroom is also extended, and cost is greatly reduced.

To obtain above objects, the following technical solution is proposed.

A unitary bathroom mainly includes an upper back panel, a lower back panel, a base, and side panels. Each of the upper back panel, lower back panel, side panels and base is provided with a surface panel which is glued to a respective panel.

A female rabbet of the upper back panel is engaged with a corresponding male rabbet of the lower back panel, and they are sealed and connected together through glass cement.

Each of the upper and lower back panels is provided with an upper adjusting component on which an adjusting screw is mounted.

A lower back panel locking plate is provided on the lower back panel. The locking plate is installed on the base through screws.

A ceiling edge-banding aluminum extrusion part of the ceiling is coupled with the upper back panel via locking screws. A skirting tile of the ceiling is mounted through screws at a corner defined between the ceiling and upper back panel.

A door frame is mounted on a front end of the base, and a stone sill is placed on the bottom portion of the door frame.

The upper back panel and side panels are connected with each other by corner braces.

The side panel has side panel male rabbets correspondingly connected with the male rabbets of the lower back panel, and they are sealed and connected by glass cement. Each of the side panel and lower back panel is provided with a gusset plate. An opening is defined in each gusset plate, and the opening of one plate matches with the opening of the other plate.

A window frame is connected with a wall body through a window sill and a listel.

Here, a water incoming conduit and water discharge conduit are arranged on the lower back panel. A water draining system is disposed on the base. A venting system is provided on the ceiling.

Here, the side panel includes an upper side panel and a lower side panel. The connecting manner by which the upper and lower side panels are connected together the same as that of the upper and lower back panels.

Here, the side panels, upper back panel, lower back panel, and ceiling are all constructed of aluminum honeycomb composite boards or paper honeycomb composite boards. Said aluminum honeycomb composite boards or paper honeycomb composite boards are formed by gluing the vesicant polyurethane, glass fiber and honeycomb core together.

Here, the gluing manner by which the upper back panel, lower back panel, side panels, base and surface panels are glued together is: twice gluing after formation of the aluminum honeycomb composite boards or paper honeycomb composite boards, or once integral molding during forming process.

Here, the ceiling is an aluminum honeycomb composite board or paper honeycomb composite board. A color aluminum plate is disposed underneath the aluminum honeycomb composite board or paper honeycomb composite board.

Here, the surface panel may be replaced with any one or more of ceramic, artificial stone, natural stone, aluminum alloy, stainless steel, zinc coated steel plate, fire proof plate, SMC and plastic.

The present invention has the following good effects: the unitary bathroom constructed according to the invention is reliable, and structurally stable. The bathroom will not be loosened after long term use. In addition, the unitary bathroom made of aluminum honeycomb composite board is lightweight, strong, and has good stiffness. The coating material may be freely selected from ceramic, artificial stone, natural stone, aluminum alloy, stainless steel, zinc coated steel plate, fire proof plate, SMC and plastic. Moreover, it has strong shock proof ability and high fire proof ability. No deformation and aging will occur after long term use.

Herein, 1 is an upper back panel, 1.1 is a female rabbet, 2 is a lower back panel, 2.1 is a male rabbet, 3 is a surface panel, 4 is a honeycomb board, 5 is glass, 6 is upper adjusting component, 7 is an adjusting screw, 8 is a lower back panel locking plate, 9 is a base, 10 is ceiling, 10.1 is ceiling edge banding aluminum extrusion part, 11 is a locking screw, 12 is ceiling skirting tile, 13 is a corner brace, 14 is a side panel, 14.1 is a side panel male rabbet, 15 is a gusset plate, 16 is a door frame, 17 is a stone sill, 18 is a wall body, 19 is a skirting tile, 20 is a window sill, and 21 is a door frame.

DETAILED DESCRIPTION OF THE INVENTION

The above technical solution is further explained with reference to the specific embodiments of the invention. It should be understood that these embodiments are only for explaining the invention, and not for limiting the scope of the invention. The conditions under which the embodiments may be practiced may be varied in accordance with specific situations of the manufacturers. The conditions not particularly described mean those of the normal experiment.

Figure 1:
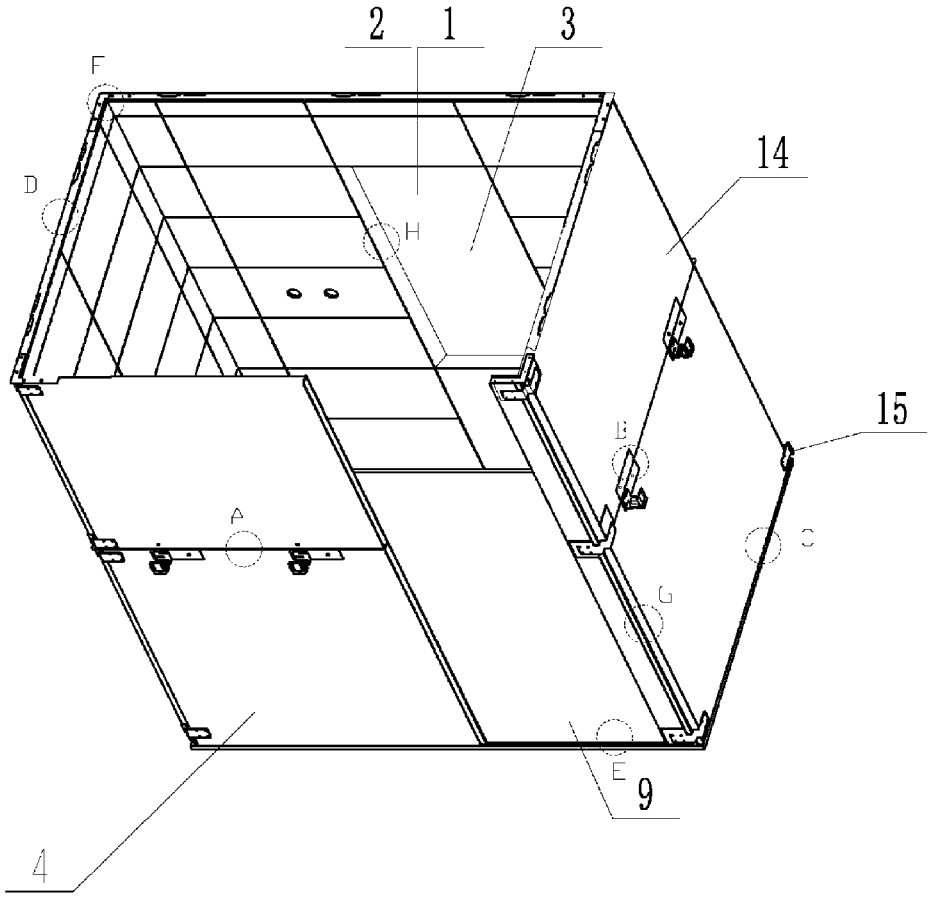
FIG. 1 is a comprehensive structural view of the invention.

As shown in FIG. 1, a unitary bathroom mainly includes an upper back panel 1, a lower back panel 2, a base 3, and side panels 14. Each of the upper back panel 1, lower back panel 2, side panels 14 and base 9 is provided with a surface panel 3 which is glued to a respective panel. The surface panel 3 may be any one or more of ceramic, artificial stone, natural stone, aluminum alloy, stainless steel, zinc coated steel plate, fire proof plate, SMC and plastic.

Figure 2:
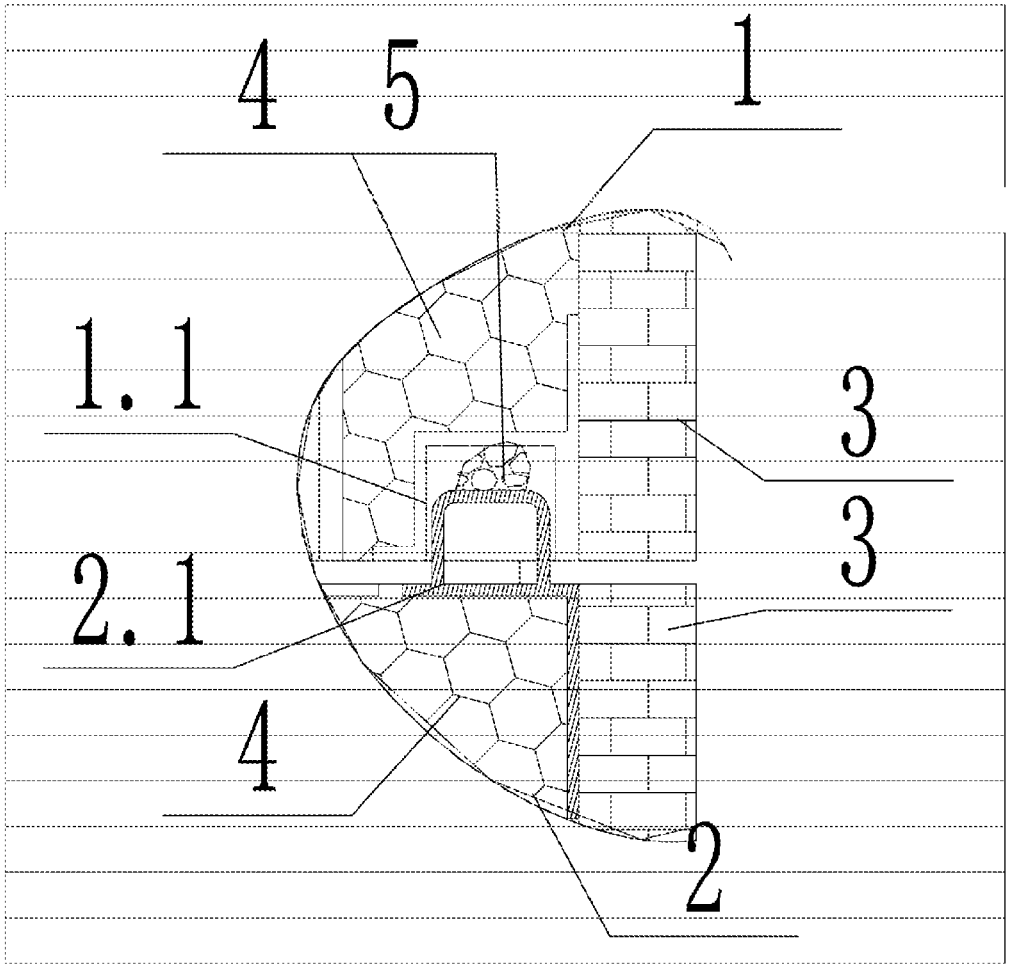
FIG. 2 is a partial cross-sectional view taken from portion A of the unitary bathroom of FIG. 1 showing water proof connecting structure of the upper and lower back panels.

As shown in FIG. 2, a female rabbet 1.1 of the upper back panel 1 is engaged with a corresponding male rabbet 2.1 of the lower back panel 2, and they are sealed and connected together through glass cement 5.

Figure 3:
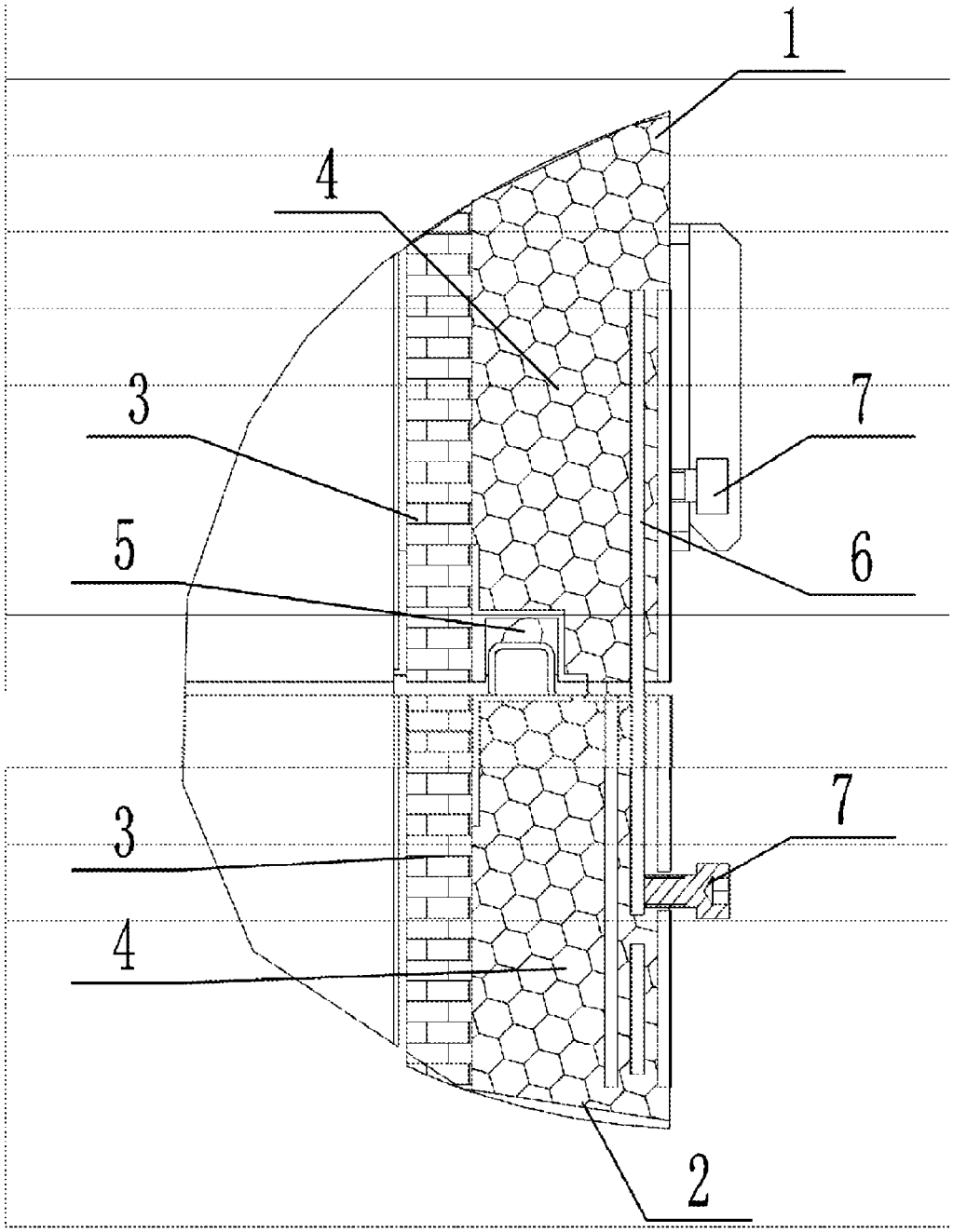
FIG. 3 is a partial cross-sectional view taken from portion B of the unitary bathroom of FIG. 1 showing an enlarged view of the connecting structure of the upper and lower back panels.

As shown in FIG. 3, each of the upper and lower back panels 1, 2 is provided with an upper adjusting component 6 on which an adjusting screw 7 is mounted.

Figure 4:
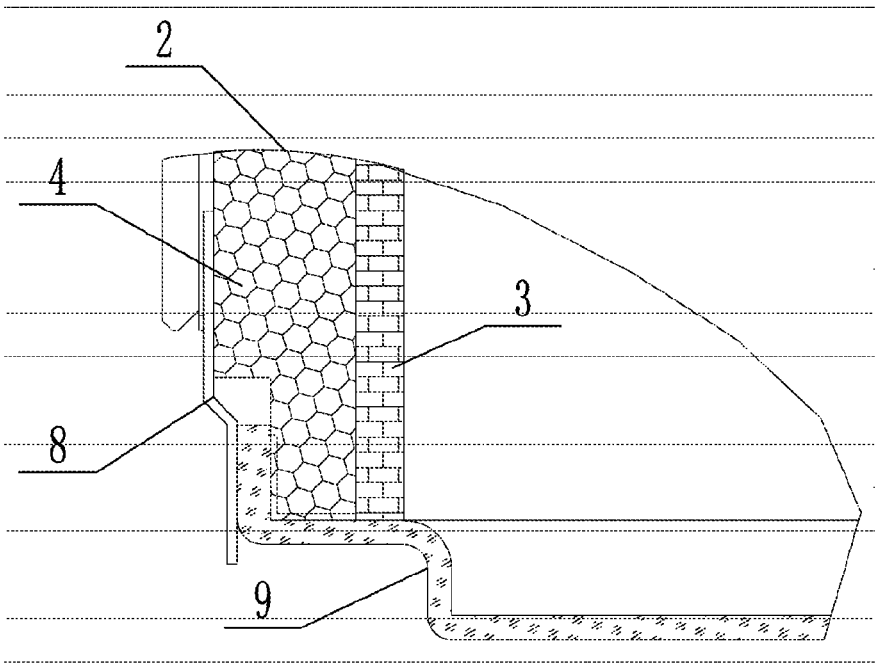
FIG. 4 is a partial cross-sectional view taken from portion C of the unitary bathroom of FIG. 1 showing connecting structure of the lower back panel and base.

As shown in FIG. 4, a lower back panel locking plate 8 is provided on the lower back panel 2. The locking plate 8 is installed on the base 9 through screws.

Figure 5:
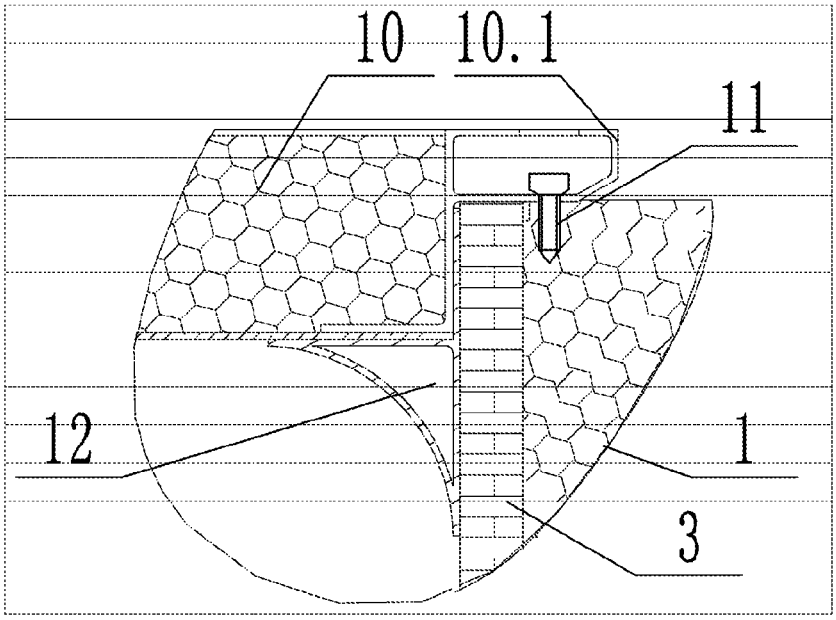
FIG. 5 is a partial cross-sectional view taken from portion D of the unitary bathroom of FIG. 1 showing connecting structure of the upper side panel and ceiling.

As shown in FIG. 5, a ceiling edge-banding aluminum extrusion part 10.1 of the ceiling 10 is coupled with the upper back panel 1 via a locking screw 11. A skirting tile 12 of the ceiling 10 is mounted through screws at a corner defined between the ceiling 10 and upper back panel 1.

Figure 6:
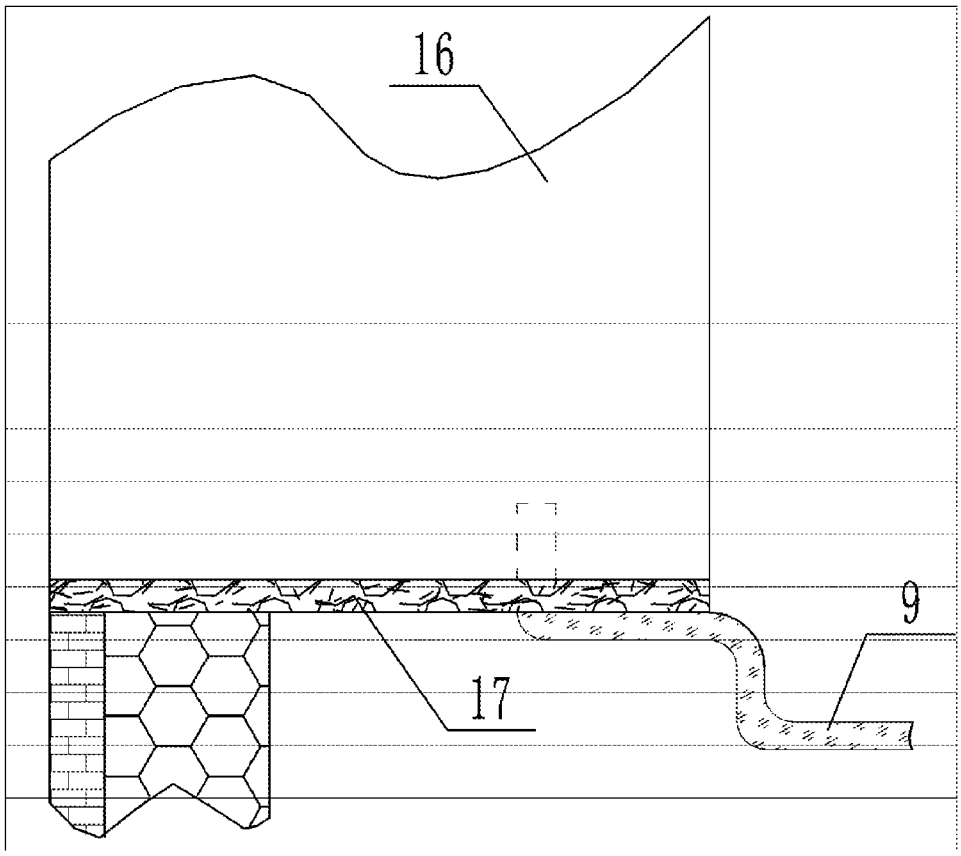
FIG. 6 is a partial cross-sectional view taken from portion E of the unitary bathroom of FIG. 1 showing connecting structure of a door and the base.

As shown in FIG. 6, a door frame 16 is mounted on a front end of the base 9, and a stone sill 17 is placed on the bottom portion of the door frame 16.

Figure 7:
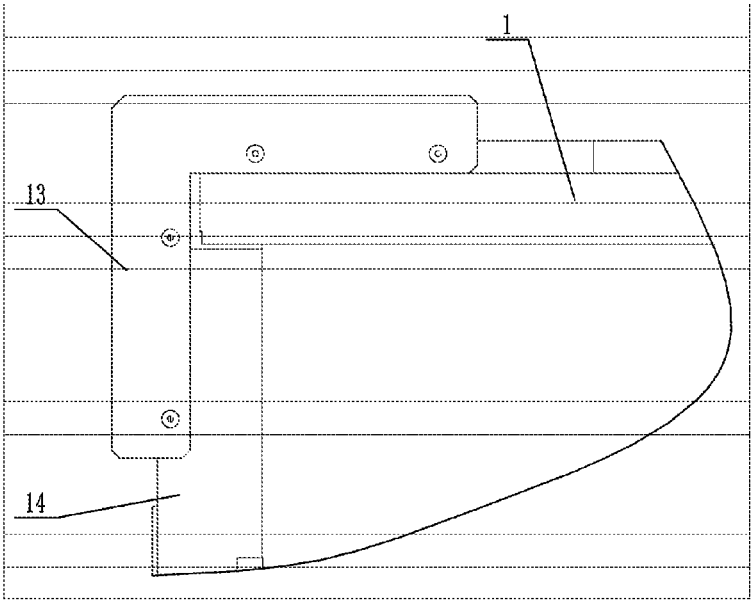
FIG. 7 is a partial cross-sectional view taken from portion F of the unitary bathroom of FIG. 1 showing connecting structure of the back panel and top portion of the side panel.

As shown in FIG. 7, the upper back panel 1 and side panel 14 are connected with each other by corner braces 13.

Figure 8:
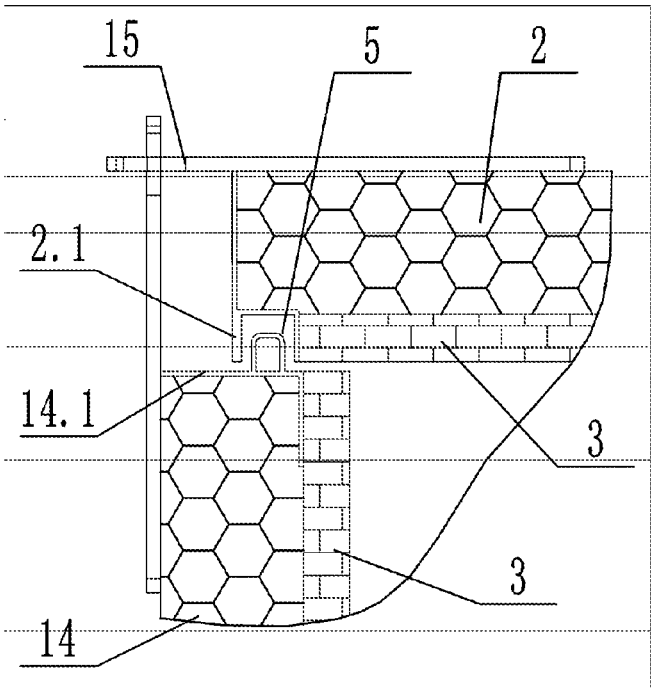
FIG. 8 is a partial cross-sectional view taken from portion G of the unitary bathroom of FIG. 1 showing water proof connecting structure of the back panel and side panel.

As shown in FIG. 8, the side panel 14 has side panel male rabbets 14.1 correspondingly connected with the male rabbets 2.1 of the lower back panel 2, and they are sealed and connected by glass cement 5. Each of the side panel 14 and lower back panel 2 is provided with a gusset plate 15. An opening is defined in each gusset plate 15, and the opening of one plate matches with the opening of the other plate.

Figure 9:
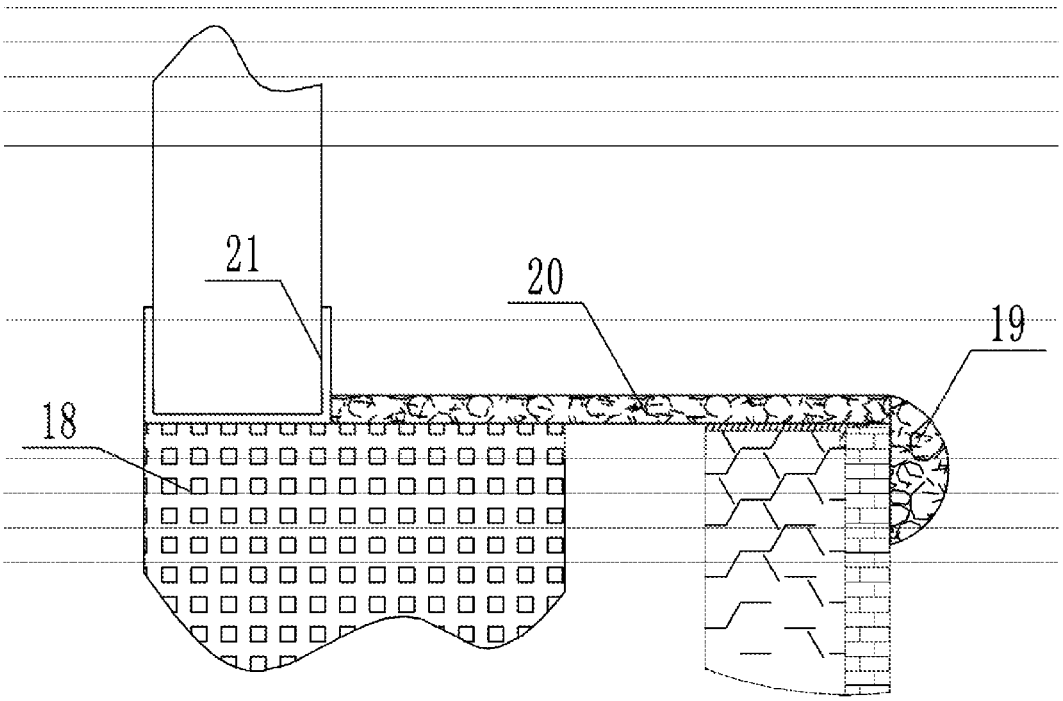
FIG. 9 is a partial cross-sectional view taken from portion H of the unitary bathroom of FIG. 1 illustrating connecting structure of a window and the unitary bathroom of the invention.

As shown in FIG. 9, a window frame 21 is connected with a wall body 18 through a window sill 20 and a listel 19.

Here, a water incoming conduit and water discharge conduit are arranged on the lower back panel 1. A water draining system is disposed on the base 9. A venting system is provided on the ceiling 10.

Here, the side panel 14 includes an upper side panel and a lower side panel. The connecting manner by which the upper and lower side panels are connected together the same as that of the upper and lower back panels 1 and 2.

Here, the side panel 14, upper back panel 1, lower back panel 2, and ceiling 10 are all constructed of aluminum honeycomb composite boards or paper honeycomb composite boards. Said aluminum honeycomb composite boards or paper honeycomb composite boards are formed by gluing polyurethane, glass fiber and honeycomb core together when the polyurethane is frothed under molding thermal pressure.

Here, the gluing manner by which the upper back panel 1, lower back panel 2, side panel 14, base 9 and surface panel 3 are glued together is: twice gluing after formation of the aluminum honeycomb composite boards or paper honeycomb composite boards, or once integral molding during forming process.

Here, the ceiling 10 is an aluminum honeycomb composite board or paper honeycomb composite board. A color aluminum plate is disposed underneath the aluminum honeycomb composite board or paper honeycomb composite board.

Here, the surface panel 3 may be replaced with any one or more of ceramic, artificial stone, natural stone, aluminum alloy, stainless steel, zinc coated steel plate, fire proof plate, SMC and plastic.

At last, it should be noted that the above embodiments are only for explaining the solution of the invention and not for limiting scope of the invention. Person of the art should understand that alterations or equivalent replacements may be made to the solution of the invention without departing from the scope and spirit of the invention through detailed description has been provided with reference to the preferred embodiments.

INDUSTRIAL APPLICABILITY

All the components of the invention are made mechanical machining and accordingly, it bears applicability in industry.

The invention claimed is:

1. A unitary bathroom comprising an upper back panel, a lower back panel, a base, and side panels, each of the upper back panel, lower back panel, side panels and base being provided with a surface panel which is glued to a respective panel, wherein a female rabbet is provided on the upper back panel, a male rabbet is provided on the lower back panel, and the female and male rabbets are engaged with each other, and they are sealed and connected together through glass cement; the upper back panel is provided with an adjusting component which is extended into the lower back panel, an adjusting screw is disposed perpendicularly to the adjusting component, and the adjusting component is secured by rotating the adjusting screw; the lower back panel is provided with an adjusting component which is extended into the upper back panel; an adjusting screw is disposed perpendicularly to the adjusting component, and the adjusting component is secured by rotating the adjusting screw; and a lower back panel locking plate is provided on the lower back panel, and the locking plate is installed on the base by screws, wherein a water incoming conduit and water discharge conduit are arranged on the lower back panel; a water draining system is disposed on the base; and a venting system is provided on a ceiling;

the side panels comprise an upper side panel and a lower side panel, the connecting manner by which the upper and lower side panels are connected together is the same as that of the upper and lower back panels;

the side panels, upper back panel, lower back panel, and ceiling are all constructed of aluminum honeycomb composite boards or paper honeycomb composite boards;

said aluminum honeycomb composite boards or paper honeycomb composite boards are formed by gluing polyurethane, glass fiber and honeycomb core together when the polyurethane is frothed under molding thermal pressure;

each surface panel is any one or more of ceramic, artificial stone, natural stone, stainless steel, zinc coated steel plate, fire proof plate, and plastic; and a ceiling edge-banding aluminum extrusion part of the ceiling is coupled with a top portion of the upper back panel via locking screws; a skirting tile of the ceiling is mounted through screws at a corner defined between the ceiling and upper back panel; a door frame is mounted on a front end of the base, and a stone sill is placed on a bottom portion of the door frame; each side panel has side panel male rabbets correspondingly connected with the male rabbets of the lower back panel, and they are sealed and connected by glass cement; each of the side panel and lower back panel is provided with a gusset plate, an opening is defined in each gusset plate, and the opening of one plate matches with the opening of the other plate; and a window frame is connected with a wall body through a window sill and a listel.

* * * * *